US005632710A

United States Patent [19]

England et al.

[11] Patent Number: 5,632,710

[45] Date of Patent: *May 27, 1997

[54] EXERCISE APPARATUS

[75] Inventors: James L. England, Auburn, Ala.; Gary T. Fox, Winona, Tex.; Randal S. Kretzler; Mark G. Hecox, both of Tyler, Tex.; Richard W. Trevino, Shreveport, La.

[73] Assignee: Roadmaster Corporation, Olney, Ill.

[ * ] Notice: The term of this patent shall not extend beyond the expiration date of Pat. No. 5,456,644.

[21] Appl. No.: 452,357

[22] Filed: May 30, 1995

Related U.S. Application Data

[63] Continuation-in-part of Ser. No. 140,289, Oct. 20, 1993, Pat. No. 5,456,644, and Ser. No. 41,681, Mar. 1, 1995, which is a continuation of Ser. No. 31,721, Dec. 5, 1994, abandoned.

[51] Int. Cl.[6] ..... A63B 21/02

[52] U.S. Cl. ..... 482/127; 482/130; 482/140

[58] Field of Search ..... 482/121, 122, 482/123, 127, 129, 130, 140, 142, 147

[56] References Cited

U.S. PATENT DOCUMENTS

| | | | |
|---|---|---|---|
| D. 263,978 | 4/1982 | Brentham . | |
| D. 281,712 | 12/1985 | Stedman . | |
| D. 300,337 | 3/1989 | Brentham . | |
| D. 335,511 | 5/1993 | Engel et al. . | |
| D. 337,361 | 7/1993 | Engel et al. . | |
| D. 344,993 | 3/1994 | Laratta . | |
| 2,855,199 | 10/1958 | Noland et al. . | |
| 3,336,021 | 8/1967 | Kramer . | |
| 3,545,737 | 12/1970 | Lamprey . | |
| 3,976,058 | 8/1976 | Tidwell . | |
| 4,023,795 | 5/1977 | Pauls . | |
| 4,023,798 | 5/1977 | Pronin . | |
| 4,072,309 | 2/1978 | Wilson . | |
| 4,171,920 | 10/1979 | Kramer et al. . | |
| 4,200,279 | 4/1980 | Lambert, Jr. . | |
| 4,240,626 | 12/1980 | Lambert, Jr. . | |
| 4,331,496 | 5/1982 | Orndorff, Jr. . | |
| 4,465,274 | 8/1984 | Davenport . | |
| 4,502,681 | 3/1985 | Blomqvist . | |
| 4,538,807 | 9/1985 | Rice | 482/147 |
| 4,566,691 | 1/1986 | Mahnke . | |
| 4,582,320 | 4/1986 | Shaw . | |
| 4,585,359 | 4/1986 | Kramer . | |

(List continued on next page.)

FOREIGN PATENT DOCUMENTS

| | | |
|---|---|---|
| 1153143 | 5/1969 | United Kingdom . |

OTHER PUBLICATIONS

Diversified Products "Fit For Life" Brochure, published by Diversified Products, Dec. 1991, 6 pages.

*Primary Examiner*—Lynne A. Reichard

*Attorney, Agent, or Firm*—Steven P. Shurtz; Brinks Hofer Gilson & Lione

[57] ABSTRACT

An exercise apparatus comprising a frame, a pivot arm mounted on the frame, a resistance mechanism, preferably an elastomeric torsion member, and a positioning element which allows the pivot arm to be pivotally adjusted with respect to the frame, independent of the resistance element, so as to vary the neutral position of the pivot arm. The preferred embodiment may also comprise a shaft mounted to the frame for conveying torque to the elastomeric torsion member and a support arm mounted to the frame to oppose rotation of the elastomeric torsion member about the shaft. In one embodiment, the exercise apparatus takes the form of a weight bench. In a second embodiment, the exercise apparatus is a home gym. In a third embodiment, the exercise machine comprises a frame, a pivot arm pivotally mounted on the frame, the pivot arm having a neutral position, the pivot arm configured to be moveable alternatively by the front and the back of a user's body, and at least one resistance member connected to the pivot arm for creating bidirectional resistance to movement of the pivot arm. In the third embodiment the machine preferably also comprises a seat, for supporting a user rotatably connected to the frame. The invention also includes the method of using the machine to perform various exercises.

24 Claims, 14 Drawing Sheets

U.S. PATENT DOCUMENTS 4,600,189 7/1986 Olschansky et al. .
4,600,196 7/1986 Jones .
4,623,144 11/1986 Rockwell .
4,627,619 12/1986 Rockwell et al. .
4,666,149 5/1987 Olschansky et al. .
4,666,152 5/1987 Jones .
4,677,721 7/1987 Kramer .
4,714,220 12/1987 Hillstrom et al. .
4,728,102 3/1988 Pauls .
4,733,860 3/1988 Steffee .
4,768,761 9/1988 Kramer .
4,778,199 10/1988 Haggerty et al. .
4,796,881 1/1989 Watterson .
4,798,377 1/1989 White .
4,840,373 6/1989 Maag .
4,850,586 7/1989 Horvath .
4,854,578 8/1989 Fulks .
4,880,319 11/1989 Haggerty .
4,902,007 2/1990 Ferrari .
4,927,007 5/1990 Kramer .
4,930,771 6/1990 Wilson ..... 482/147
4,979,736 12/1990 Maynard .
4,979,737 12/1990 Kock .
5,002,271 3/1991 Gonzales .
5,007,660 4/1991 Orndorff, Jr. et al. .
5,056,779 10/1991 Webb .
5,062,633 11/1991 Engel et al. .
5,066,004 11/1991 Jones .
5,072,929 12/1991 Peterson et al. .
5,090,694 2/1992 Pauls et al. .
5,094,449 3/1992 Stearns .
5,120,289 6/1992 Yu .
5,122,105 6/1992 Engel et al. .
5,129,873 7/1992 Henderson et al. .
5,147,265 9/1992 Pauls et al. .
5,160,305 11/1992 Lin .
5,195,937 3/1993 Engel et al. .
5,211,617 5/1993 Millen .
5,215,511 6/1993 Cheng ..... 482/121
5,217,487 6/1993 Engel et al. .
5,226,866 7/1993 Engel et al. .
5,244,446 9/1993 Engel et al. .
5,256,126 10/1993 Grotstein ..... 482/142
5,277,684 1/1994 Harris .
5,295,931 3/1994 Dreibelbis et al. .
5,300,005 4/1994 Wang .
5,302,161 4/1994 Loubert et al. .
5,338,277 8/1994 Yang .
5,344,376 9/1994 Bostic et al. .
5,374,228 12/1994 Buisman et al. .
5,407,414 4/1995 Bass ..... 482/121
5,441,473 8/1995 Safani et al. ..... 482/130

EXERCISE APPARATUS

CROSS REFERENCE TO RELATED APPLICATIONS

This application is a continuation-in-part of design application Ser. No. 29/041,681, which is a continuation of design application Ser. No. 29/031,721 filed on Dec. 5, 1994 now abandoned. This application is also a continuation-in-part of utility application Ser. No. 08/140,289 filed on Oct. 20, 1993 now U.S. Pat. No. 5,456,644.

BACKGROUND OF THE INVENTION

The present invention relates to resistance machines for exercise. The prior art is replete with examples of exercise machines. Exercise machines known in the art, such as weight benches, often comprise a frame with a shaft and a pivot arm attached to it. Weights are loaded on the shaft. The pivot arm functions as a handle for the person exercising. In some machines, the exerciser has the option of moving the handle to one of several positions before using the machine. This option enables the user to exercise several different muscle groups with the same machine. In order to move the pivot arm of the weight benches presently known in the art, the exerciser must remove the weights on the shaft, adjust the handle and replace the weights before beginning to exercise. This process is tedious and time consuming. The person exercising wastes valuable time removing and replacing weights. An exercise machine that does not require removing the weights to adjust the pivot arm would save exercisers' time and also increase their enjoyment of the machine.

Prior art exercise machines commonly provide weights as a source of resistance. However, resistive force may also be created by different mechanisms. Rubber elements used as stretchable members have been widely used to oppose motion of certain mechanisms in an exercise machine. While the use of rubber elements provides an advantage in that heavy weights are not required to create resistance, many of the resistance machines known in the art are complicated and cumbersome. An exercise machine that uses rubber elements and that is easy to adjust so that different muscle groups can be exercised, and that is simple and durable, would be a welcome improvement.

Prior art exercise machines which target the abdominal or back muscles generally only exercise one muscle group. Consequently, in order to tone the abdominal muscles, the oblique muscles and the lower back muscles, the user is forced to operate three different machines. A compact exercise machine that targets the abdominal muscles, the oblique muscles and the lower back muscles would be a welcome improvement.

SUMMARY

In the first aspect, the resistance machine of the present invention includes a frame, a pivot arm mounted on the frame, a resistance mechanism and a positioning element which allows the pivot arm to be pivotally adjusted with respect to the frame, independent of the resistance element, so as to vary the neutral position of the pivot arm. In the preferred embodiment, the resistance mechanism is a torsion elastic spring.

In the second aspect, the exercise apparatus of the present invention embodies a frame, at least one elastomeric torsion member for creating resistance, a shaft mounted to the frame for conveying torque to the elastomeric torsion member, a support arm mounted on the frame for opposing rotation of the elastomeric torsion member about the axis of the shaft and a pivot arm mounted on the frame and connected to the shaft so that movement of the pivot arm is resisted by the elastomeric torsion member.

In the third aspect, the exercise apparatus of the present invention includes a frame, a pivot arm pivotally connected to the frame, at least one arm lever attached to the pivot arm by a pivot axis which allows the arm lever to rotate with respect to the pivot arm, at least one resistance mechanism connected to the arm lever to resist rotation of the arm lever with respect to the pivot arm, and a lock-out mechanism to prevent the pivot arm from pivoting with respect to the frame.

In the fourth aspect, the exercise apparatus of the present invention embodies a frame, a cross bar attached to the frame, two arm levers, each connected to the cross bar by a pivot axis, and two torsion elastic springs mounted on the frame, each torsion elastic spring opposing rotation one of the arm levers with respect to the cross bar.

One of the advantages of the invention is that the positioning element makes the exercise machine extraordinarily easy to use and conditions different muscle groups. Another advantage lies in the simplicity and durability of the resistance mechanism.

A second embodiment of the invention is an abdominal/back exercising apparatus. In the first aspect, the abdominal/back apparatus of the present invention includes a frame, a pivot arm pivotally mounted to said frame having a neutral position, the pivot arm configured to be moveable alternatively by the front and back of a user's body and at least one resistance member connected to the pivot arm for creating bidirectional resistance to movement of the pivot arm.

In the second aspect, the abdominal/back exercising apparatus of the present invention includes a frame, a seat rotatably connected to the frame, a pivot arm pivotally mounted to said frame, the pivot arm having a neutral position and configured to be moveable alternatively by the front or back of a user's body and at least one resistance member connected to the pivot arm for creating bidirectional resistance to movement of the pivot arm.

In the third aspect, the abdominal/back exercising apparatus of the present invention includes a frame, a pivot arm mounted on the frame, at least one elastomeric torsion member for creating resistance to movement of the pivot arm mounted on the frame, a shaft pivotally mounted to the frame for conveying torque to the elastomeric torsion member, the shaft possessing a noncircular cross-section, and a support arm mounted on the frame for opposing rotation of the elastomeric torsion member about the axis of the shaft, wherein the neutral position of the pivot arm may be pivotally adjusted with respect to the frame by repositioning the elastomeric torsion member on the shaft.

In the fourth aspect, the present invention includes a method of changing the neutral position of a pivot arm on a resistance machine for exercise comprising the steps of removing the elastomeric torsion member from the shaft, rotating the pivot arm from a first neutral position to a second neutral position and replacing the elastomeric torsion member on the shaft.

The invention also includes the method of using the abdominal/back exercising apparatus to perform various exercises.

One of the advantages of the preferred embodiment of the abdominal/back apparatus is that the apparatus allows an exerciser to work the abdominal, oblique and back muscles.

Another advantage of the invention is that it is very easy to use as well as compact and durable.

These and other advantages, as well as the invention itself, will be best understood in view of the attached drawings, a brief description of which follows.

DETAILED DESCRIPTION OF THE DRAWINGS AND PREFERRED EMBODIMENTS OF THE INVENTION

Figure 1:
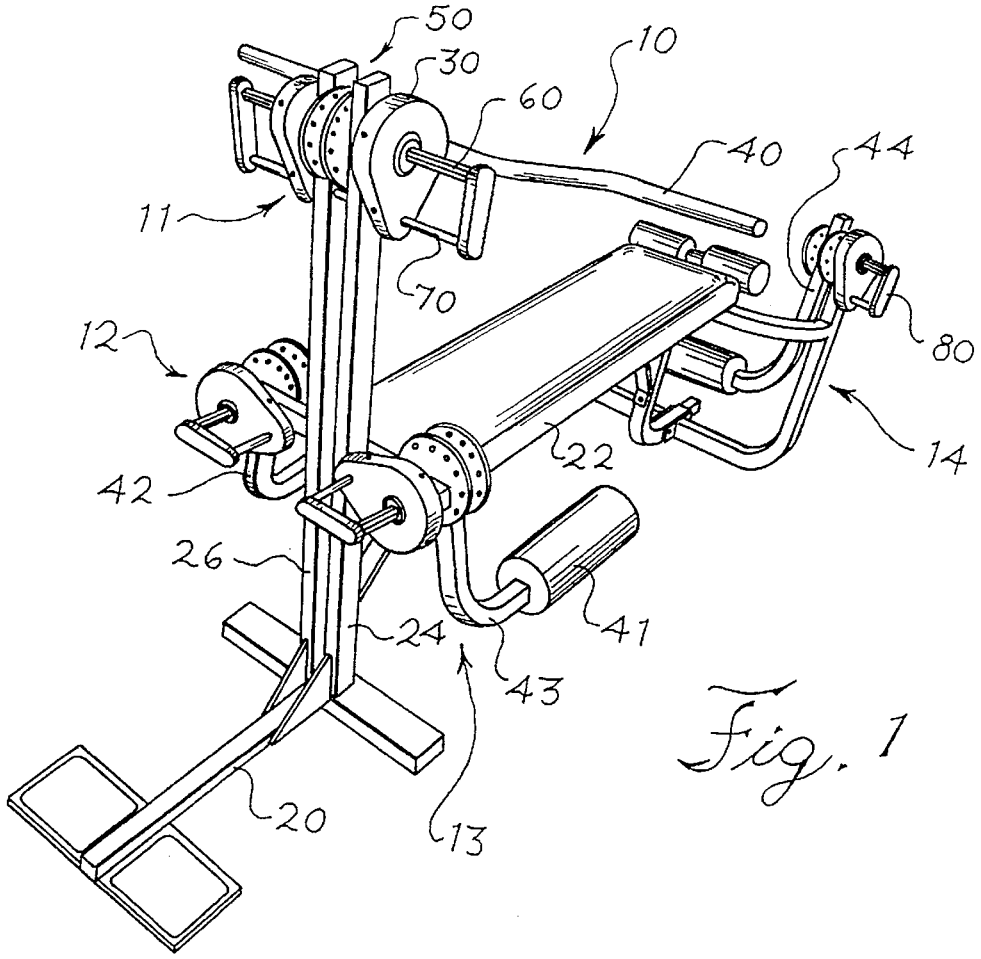
FIG. 1 is a perspective view of a first preferred embodiment of the exercise apparatus of the present invention.

Referring initially to FIG. 1, a preferred embodiment of the resistance machine for exercise of the present invention is a weight bench 10. As illustrated, the weight bench 10 includes a frame 20. The frame 20 supports a longitudinally extending bench 22 with a pair of upright members 24 and 26 mounted to one end of the bench and a third leg 25 mounted at the opposite end of the bench. Upright members 24 and 26 each extend upwardly to support various elements of the invention which will be described hereafter. It should be understood that the particular shape of the frame 20 is not critical to the present invention. The frame 20 provides a surface for mounting other members and a base 23 which prevents the machine 10 from tipping during use.

The embodiment of FIG. 1 also includes four exercise stations, 11, 12, 13, and 14 which each include a resistance mechanism 30 and a pivot arm 40, 42, 43 or 44. Exercise station 11 is used for exercising the upper body, specifically the chest muscles. Exercise stations 12 and 13 are used to condition the arms. Exercise station 14 is used to exercise the leg muscles. In other embodiments of the invention, fewer or more exercise stations may be mounted on the frame. The pivot arm 40, 42, 43 or 44 of each exercise station may have a cushioning pad 41 surrounding its free end which provides comfort to the exerciser. Movement of the pivot arm 40, 42, 43 or 44 is opposed by the resistance mechanism 30. A positioning element 50 allows the pivot arm 40, 42, 43 or 44 to be adjusted with respect to the frame 20, independent of the resistance mechanism 30, so as to vary the neutral position of the pivot arm 40, 42, 43 or 44.

At each exercise station there is a shaft 60 and a support arm 70 attached to the frame 20. The shaft 60 and support arm 70 are inserted into corresponding apertures in the frame 20 and are thus held securely in place.

Figure 2:
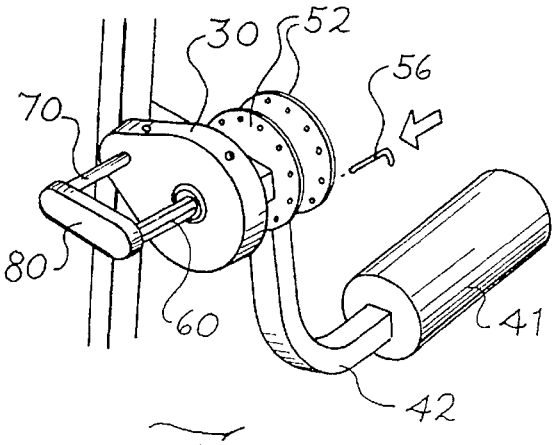
FIG. 2 is a perspective view of the pivot arm and positioning element of FIG. 1 in a first position.
Figure 3:
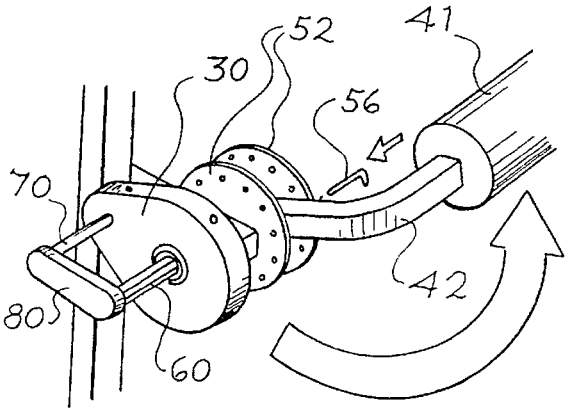
FIG. 3 is a perspective view of the pivot arm and positioning element of FIG. 1 in a second position.

FIGS. 2 and 3 illustrate how the pivot arm 40 may be adjusted without moving the resistance mechanism 30. In FIG. 2, the pivot arm 40 is in a first position. In the preferred embodiment, the positioning element 50 consists of two disk-shaped plates 52 with the pivot arm 40 mounted in between them. When it becomes necessary to move the pivot arm 40 to perform a different exercise, one merely removes the pin 56 from the positioning plates 52, moves the pivot arm 40 to another position and reinserts the pin 56 into the positioning plates 52. In the preferred embodiment, pivot arm 40 also possesses a corresponding hole for receiving the pin 56. FIG. 3 illustrates the pivot arm 40 in a second position.

Figures 4, 5, 6:
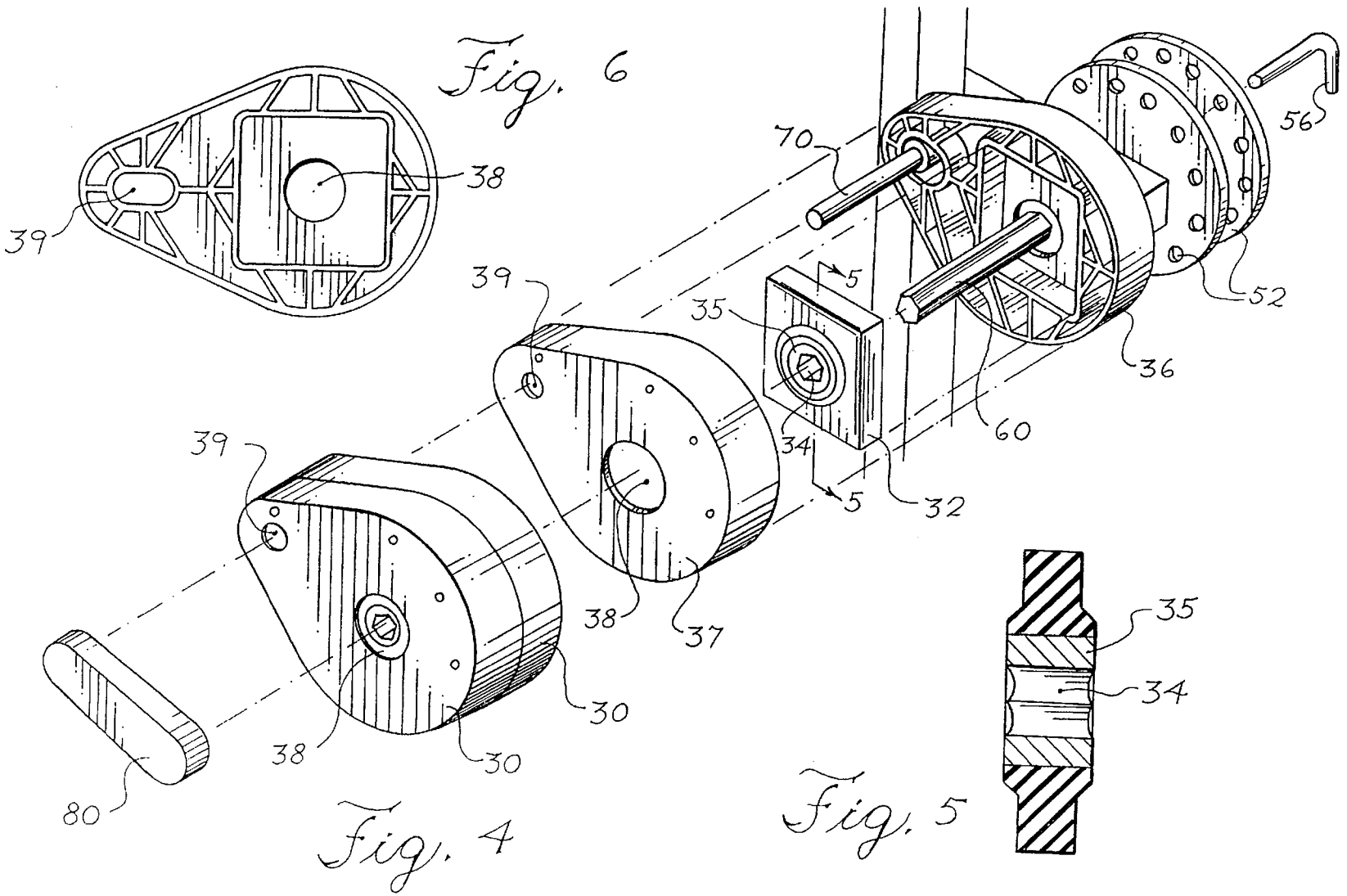
FIG. 4 is an exploded view of the preferred resistance mechanism of FIG. 1.
FIG. 5 is a cross-sectional view of the torsion elastic spring of FIG. 4.
FIG. 6 is a perspective view of the torsion elastic spring casing of FIG. 4.

The various components of the preferred resistance mechanism 30 are depicted in FIG. 4. The primary component of the resistance mechanism 30 is a torsion elastic spring 32. In the preferred embodiment, the torsion elastic spring 32 has a square shape with a central bore 34 that is lined with a casing 35. In the preferred embodiment, the casing 35 is rigid and corresponds to the shape of the shaft 60. Most preferably, the casing 35 inside the central bore 34 is aluminum and has a hexagonal internal shape. See FIG. 5. A preferred torsion elastic spring with such a core is sold by the B.F. Goodrich Company, 6061 B.F. Goodrich Boulevard, Blount Island, Jacksonville, Fla., 32226 under the trademark TORSILASTIC®.

The torsion elastic spring 32 is placed into a plastic casing consisting of two halves 36 and 37. As depicted in FIG. 6, the casing is fibbed to provide structure and support to the torsion elastic spring 32. The two halves 36 and 37 are symmetrically shaped, each containing a central aperture 38 for receiving a shaft 60. The two halves 36 and 37 also possess an aperture 39 at the bottom of the casing which receives support arm 70. The support arm 70 prevents the rotation of the torsion elastic spring 32 about the axis of the shaft 60. The casing is designed to transmit force between the torsion elastic spring 32 and the aperture 39.

Before the resistance mechanism 30 is loaded onto the frame 20, the torsion elastic spring 32 is put into one half of the casing 36. The other haft of the casing 37 is then placed over the first haft of the casing 36 and the torsion spring 32. The two halves of the casing 36 and 37 are then held together by an appropriate means. In the preferred embodiment, screws are inserted into corresponding holes in the casing. See FIG. 4. The assembled resistance mechanism 30 may then be positioned onto the shaft 60 and the support arm 70. Preferably, the cross-section of the shaft 60 and the casing 35 lining the central bore 34 of the torsion elastic spring 32 have a corresponding shape. Most preferably, the shaft 60 and casing 35 are both hexagonally shaped. This design enables the shaft 60 to convey torque to the torsion elastic spring 32. After the desired number of resistance mechanisms 30 are placed onto the frame 20, an end cap 80 may optionally be positioned over the end of both the shaft 60 and support arm 70 as a safety measure. The casing 35 preferably has chamfered edges as shown in FIG. 5 to allow for easier placement of the torsion elastic spring 32 onto shaft 60.

The amount of resistance produced by the torsion elastic spring 32 is a function of the length of the moment arm and the durameter and other properties of the rubber. The casing 35 inside the central bore 34 of the torsion elastic spring 32 affects the length of the moment arm and therefore must factor into the design specifications. Thus different configurations of the torsion elastic member may be used to provide different levels of resistance. Hence, one resistance element could provide the equivalent of 10 lbs. of resistance, and another 5 lbs. of resistance. A user desiring the equivalent of 25 lbs. of resistance would then use two 10 lb. and one 5 lb. equivalent resistance elements on shaft 60.

The weight bench 10 will be better understood by explaining the mechanics of each exercise station. Referring to the first exercise station 11, the user either sits or lies on bench 22 after adjusting pivot arm 40 to the position corresponding to the desired exercise. The user then pushes upward on pivot arm 40. The forces transmitted through positioning pin 56 and plates 52 consequently rotate shaft 60. The rotation of shaft 60 causes the inner rubber of the torsion elastic spring 32 to rotate. Outer casing 36, 37 of the torsion elastic spring 32 is secured to support arm 70. The support arm 70 opposes the rotation of the elastomeric torsion member 32 about the axis of the shaft 60. Torsion elastic spring 32 thus resists the movement of pivot arm 40 and returns it to its neutral position.

Exercise stations 12 and 13 may be utilized either separately or together. An example of one exercise capable of being performed by exercise stations 12 or 13 occurs when the user lies face down on bench 22 and places both arms under pivot arms 42 and 43. The user's forearms rest along cushioning pads 41. The user pushes the pivot arms 42, 43 upward until they are even with the user's shoulders. This causes rotation of the positioning pin, positioning plates, shafts and torsion elastic springs of exercise stations 12 and 13. The support arms of these two stations 12, 13 oppose the rotation of the torsion elastic springs 32. This exercises may be performed when the user is lying on either his back or his stomach. As stated earlier, this same exercise may be practiced using either exercise station 12 or 13 independently.

Finally, exercise station 14 conditions the leg muscles. The user adjusts pivot arm 44 to a downward position. The user sits on bench 22 so that the user's knees are at the end of the bench 22 and the user's legs are behind cushioning pad 41 of pivot arm 44. The user pushes the lower legs upward until they are almost even with the upper legs. Alternatively, the user may position pivot arm 44 in an upward position and lie on bench 22 so that the user's ankles are underneath cushioning pad 41. The user bends the legs backwards so that pivot arm 44 is pulled towards the user's buttocks. Both of the above described exercises may be performed using a single leg. Both exercises result in rotation of pivot arm 44 which causes the positioning pin, positioning plates, shafts and torsion elastic springs to rotate. Again, the support arm opposes the rotation of the torsion elastic spring.

Figure 7:
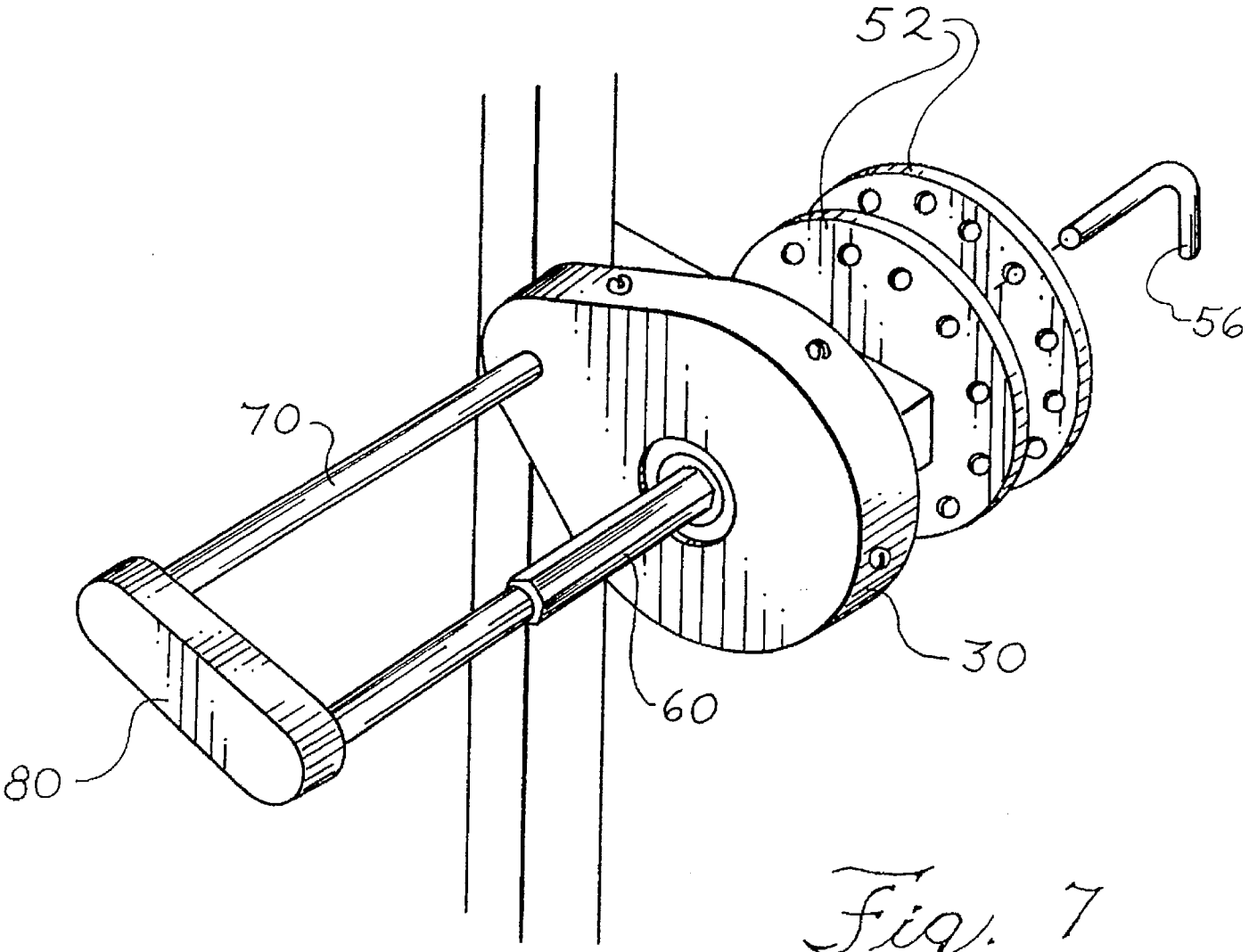
FIG. 7 is a perspective view of a second embodiment of the hexagonally shaped shaft of FIG. 1.

One variation of the preferred embodiment of the invention, illustrated in FIG. 7, lies in modifying the shaft 60 so that it has a hexagonal cross-section through its body and becomes rounded on its ends. This modification allows the exerciser to change the resistance on the machine 10 without completely removing or replacing the resistance mechanisms 30. A predetermined number of resistance mechanisms 30 are placed on the shaft 60 at its rounded end. Since the casing 35 inside the central bore 34 of the torsion elastic spring 32 is hexagonal, the torsion elastic spring 32 does not engage the shaft 60 in this position. The amount of resistance is changed by sliding the appropriate number of resistance mechanisms on to the hex-shaped part of the shaft 60, thereby engaging the torsion elastic spring 32 inside the resistance mechanism. The advantage of this variation is that it allows the exercisers to make more efficient use of their time since they do not have to remove or replace the resistance elements on the machine 10. This inherently leads to increased satisfaction with the machine 10.

Figure 8:
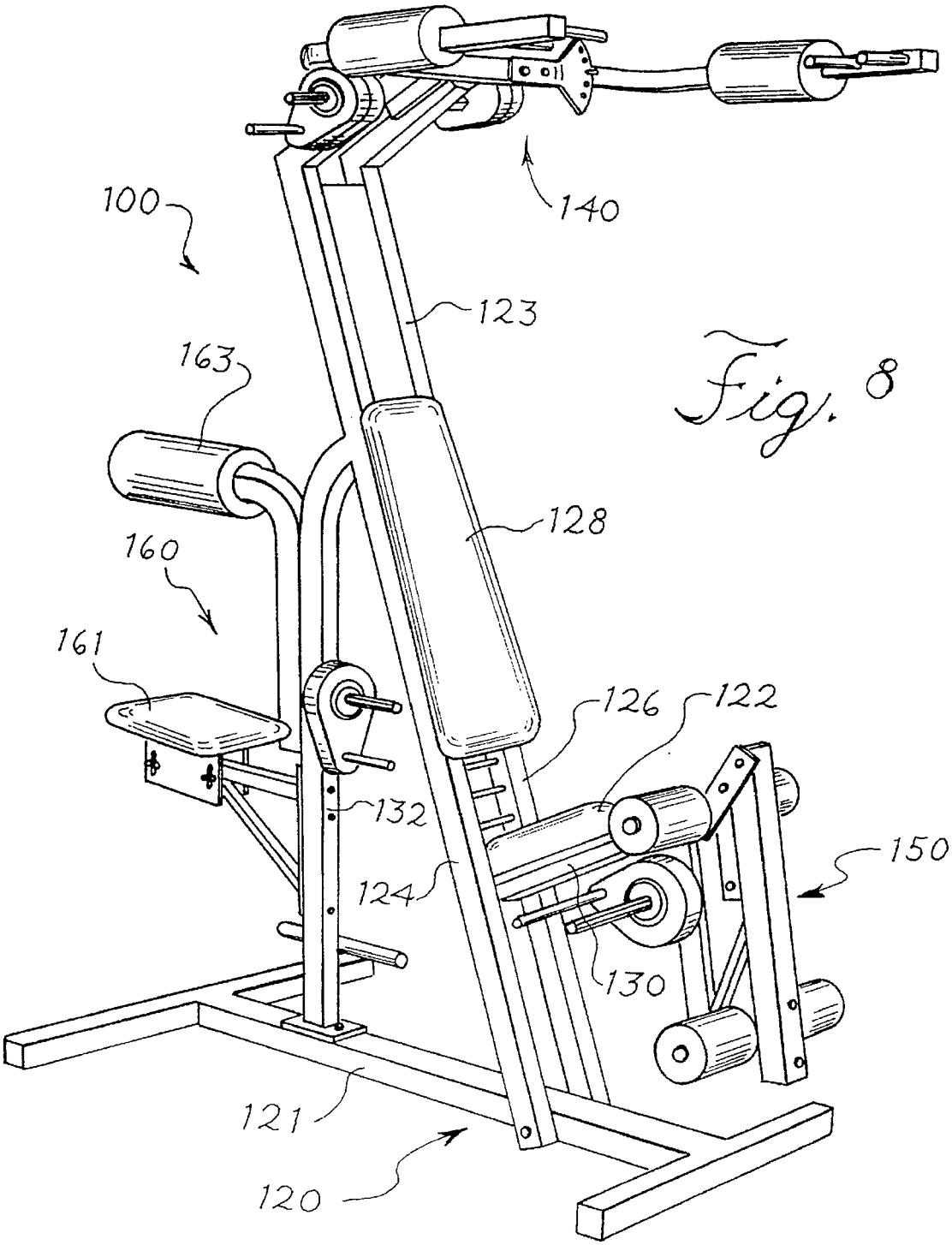
FIG. 8 is a perspective view of a second preferred embodiment of the exercise apparatus of the present invention.

Referring now to FIG. 8, a second embodiment of the present invention is a multiposition home gym. As illustrated, the home gym 100 includes a frame 120. The frame includes base 121 as well as two upright members. The first upright member 123 is comprised of two spaced, parallel bars 124 and 126. Upright member 123 extends upwardly to support a first exercise station 140 which will be described hereafter. The upright member 123 also supports a back pad 128. The first seat 122 rests on member 130 which is mounted between bars 124 and 126. The first upright member 123 is comprised of two spaced, parallel bars. Member 130 supports a second exercise station 150 at its opposite end. A second upright member 132 extends upwardly from frame base 121 and intersects upright member 123 at a midpoint of the first upright member 123. Upright member 132 supports a third exercise station 160.

Referring now to the details of each exercise station, the first exercise station 140 is depicted in FIGS. 9A–9D. This station includes a resistance mechanism 141 and a pivot arm 142. In the preferred embodiment, pivot arm 142 is connected to the center of a bar 242 which acts as a cross member and projects laterally in opposite directions. Each end of the bar 242 connects to an arm lever 143, 144. Arm levers 143,144 are attached to the bar 242 by a pivot axis 145 which allows the lever to rotate with respect to the bar 242. Positioning plate 149 and corresponding pin 249 lock arm levers 143, 144 in position for certain exercises. Each arm lever 143 and 144 may also have a pair of hand grips 146 and a cushioning pad 147.

Movement of the pivot arm 142 is opposed by the resistance mechanism 141. A positioning dement 148 allows the pivot arm to be adjusted with respect to the frame 120, independent of the resistance mechanism 141, so as to vary the neutral position of the pivot arm 142. Positioning elements 148 and 149 operate in the same fashion as position element 50 of the weight bench 10. The combination of variations of the neutral position of the pivot arm 142 and the arm levers 143, 144 allow the user to perform a variety of exercises. In a preferred embodiment, the holes of positioning plates 148 are labeled with the exercise performed when pivot arm 142 is locked into that position. The resistance mechanism 141 may be positioned either vertically on the top of upright member 123 (FIG. 9A) or horizontally, on pivot axes 145 (FIG. 9D).

Figure 10:
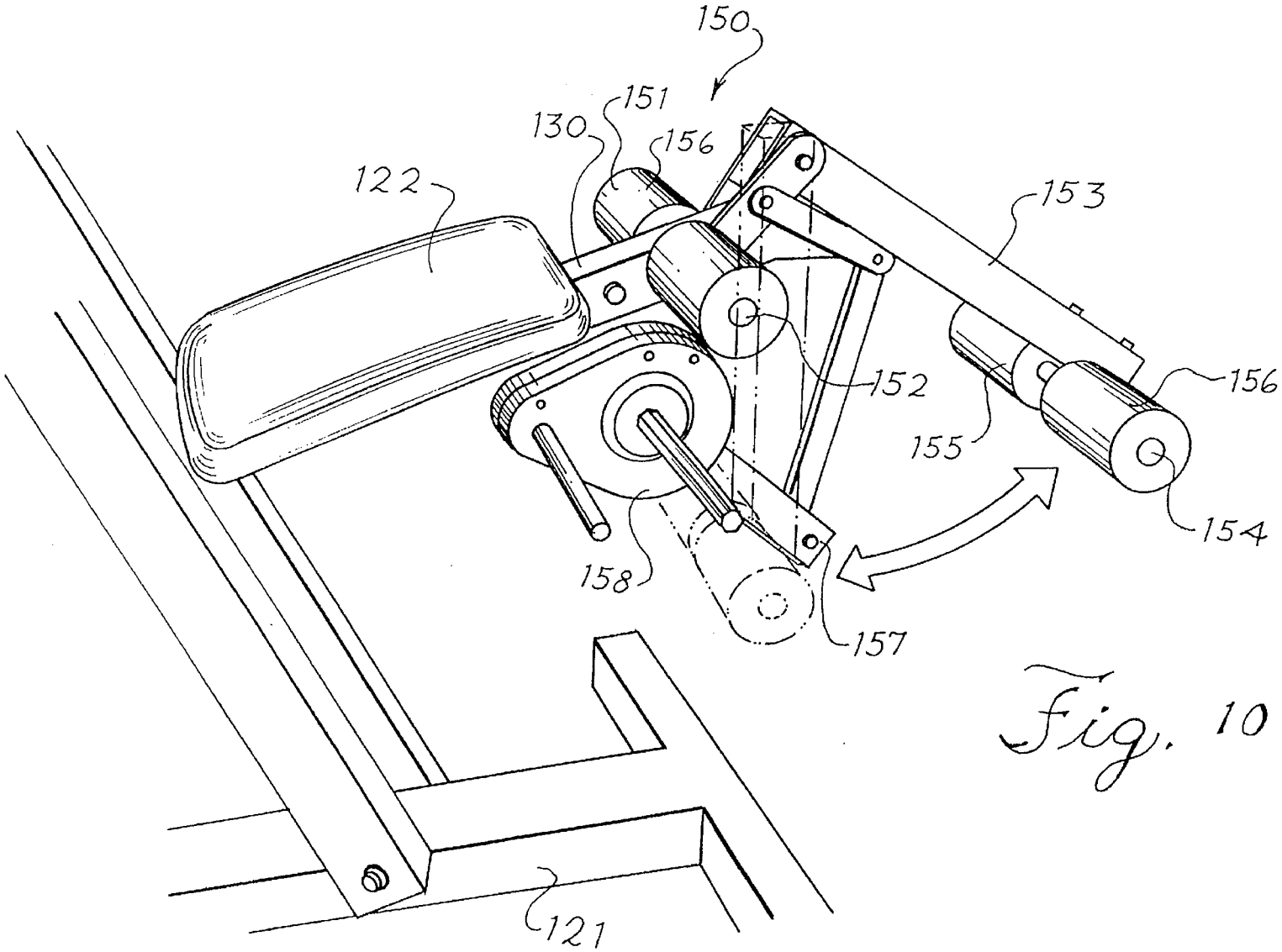
FIG. 10 is a perspective view of a second exercise station of the apparatus of FIG. 8.

The second exercise station 150, illustrated in FIG. 10, also includes a resistance mechanism 158. Horizontal member 130 has two knee supports 151,152 extending laterally near its distal end. Pivot arm 1 is mounted on the distal end of horizontal member 130. Pivot arm 1 has a pair of ankle supports 154 and 155 mounted on its distal end. Both knee supports 151, 152 and ankle supports 154, 155 may be surrounded by cushioning pads 156. Horizontal member 130 also supports upright member 157. Upright member 157 extends downward toward frame base 121. Upright member 157 supports the resistance member 158 of the second exercise station 150.

Figure 11:
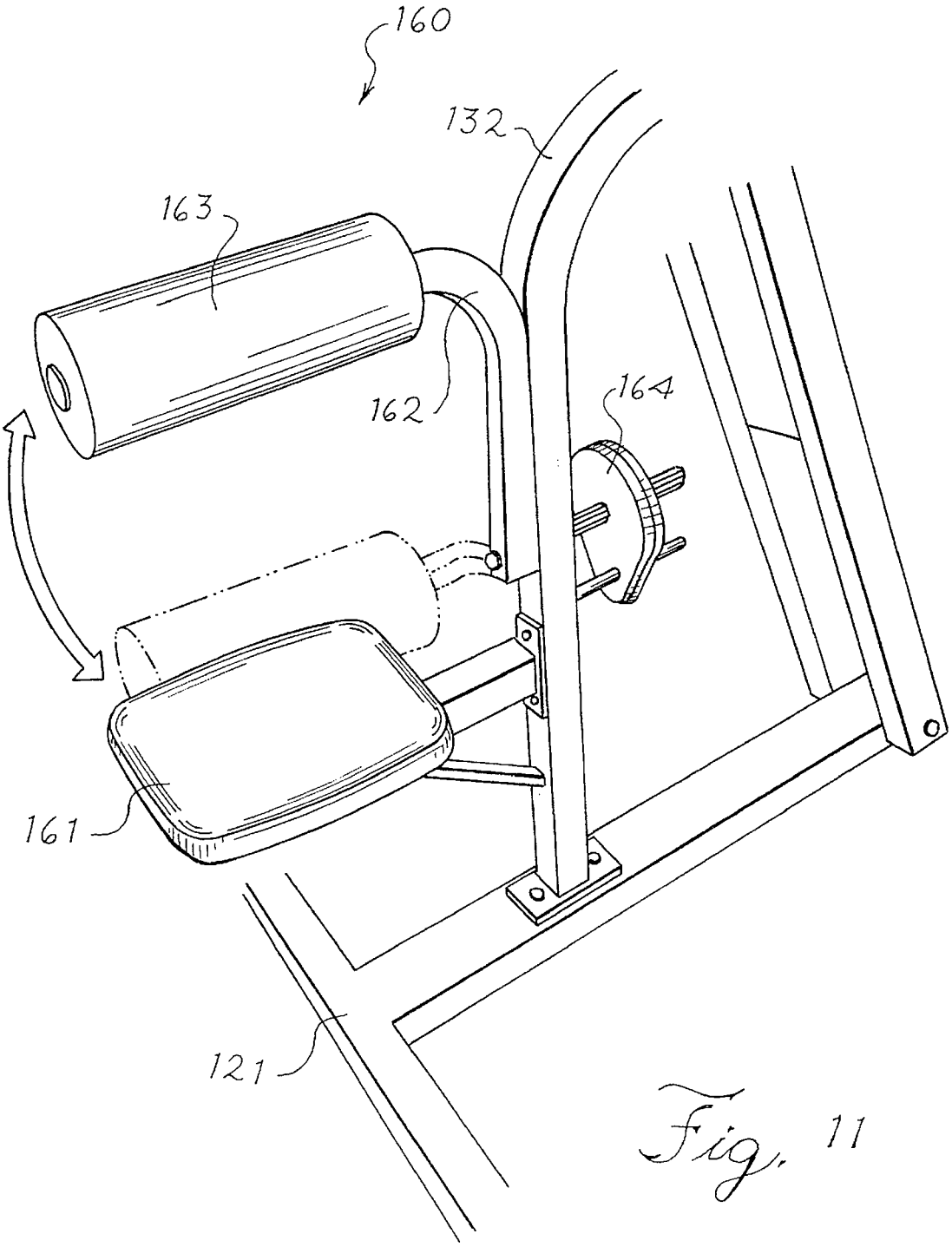
FIG. 11 is a perspective view of a third exercise station of the apparatus of FIG. 8.

FIG. 11 depicts the third exercise station 160. This station comprises a second seat 161 and a pivot arm 162 which are both attached to upright member 132. Pivot arm 162 may have a cushioning pad 163 surrounding its free end. Resistance mechanism 164 is also supported by upright member 132.

The home gym 100 will be better understood by describing the various exercises a user may perform. There are four exercises that may be performed using the first exercise station 140. Returning to FIG. 9A, the user may perform seated bench presses by positioning pivot arm 142 in a downward position. The user sits on the first seat 122 with the user's back against back support 128 and pushes arm levers 143 and 144 out in a forward motion.

Figure 9A:
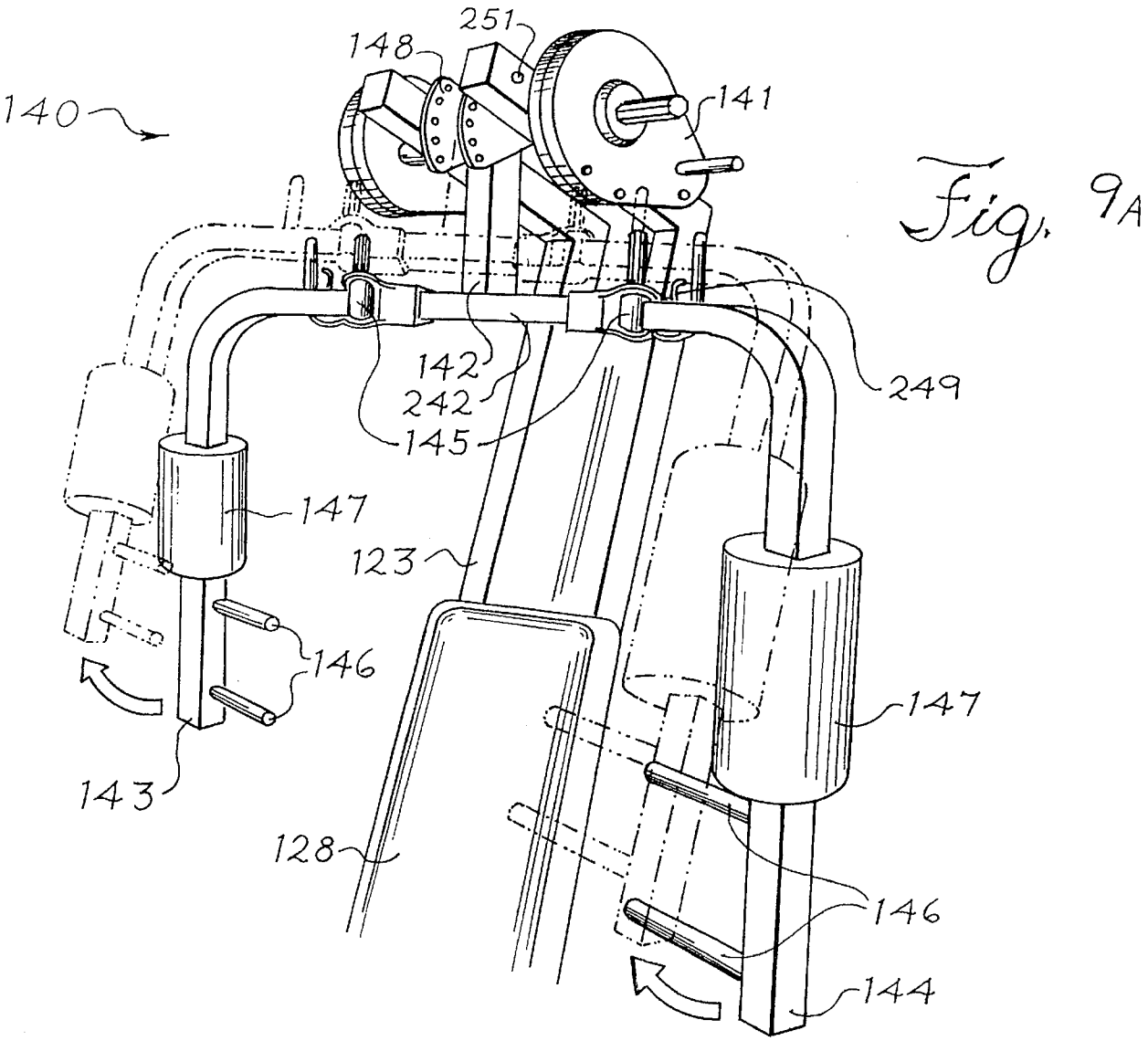
FIGS. 9A–9D are perspective views of the top exercise station of the apparatus of FIG. 8 in different exercise positions.
Figure 9B:
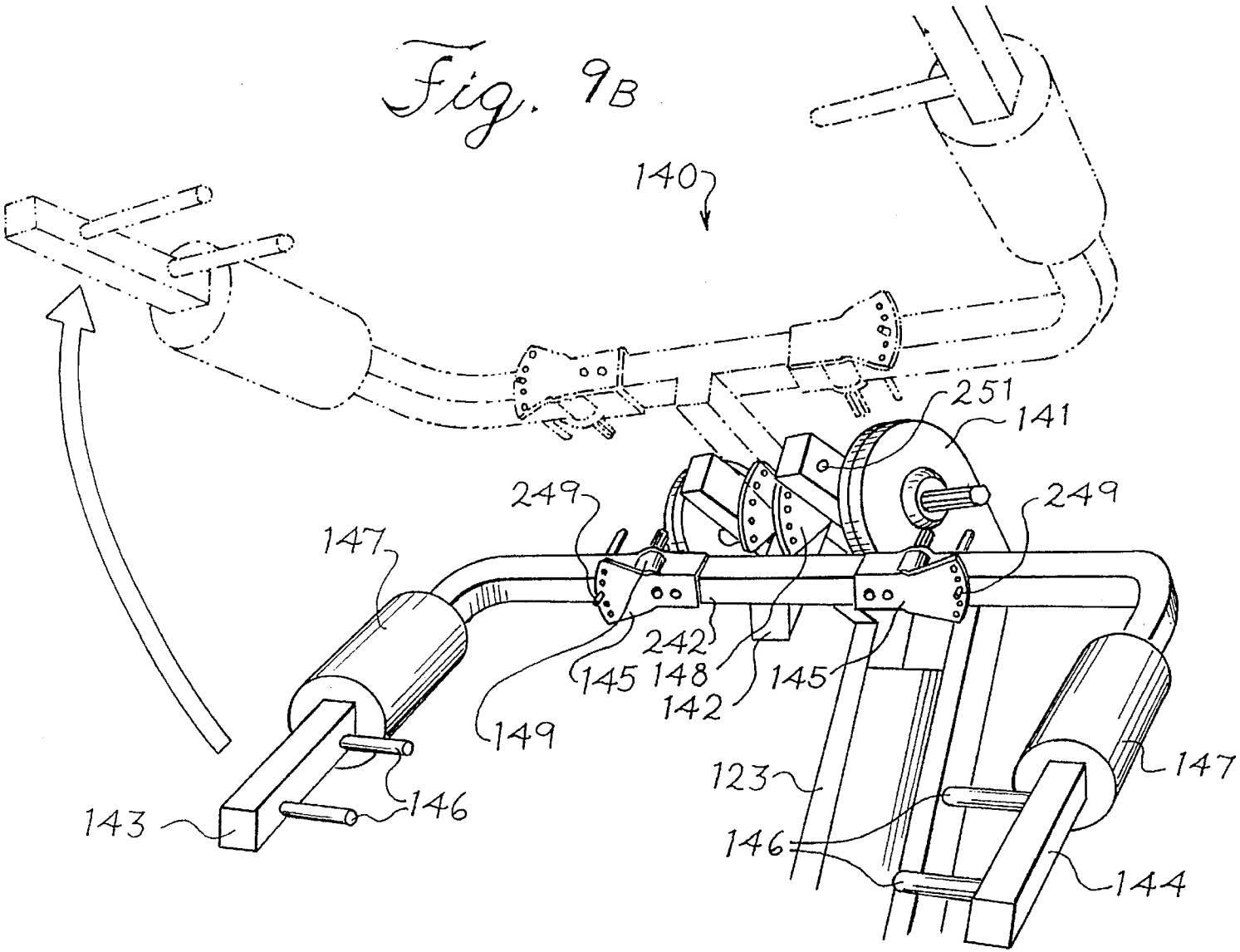

The second exercise, called military presses, is performed with pivot arm 142 in a mid-location, shown in FIG. 9B, causing arm levers 143 and 144 to assume an upward and forward position. Here, the user turns around and faces the machine. While sitting on seat 122, the user presses arm levers 143 and 144 upward.

Figure 9C:
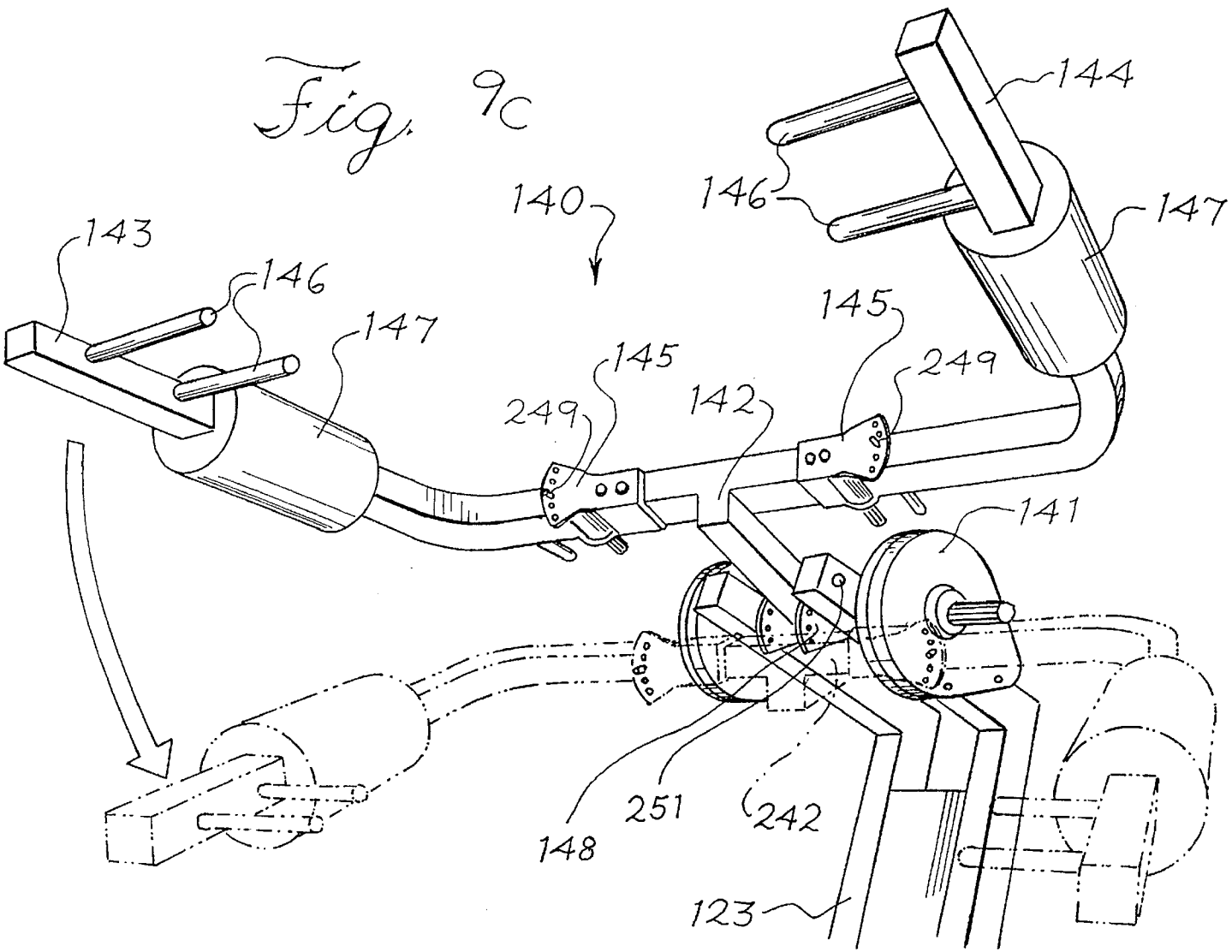
Figure 9D:
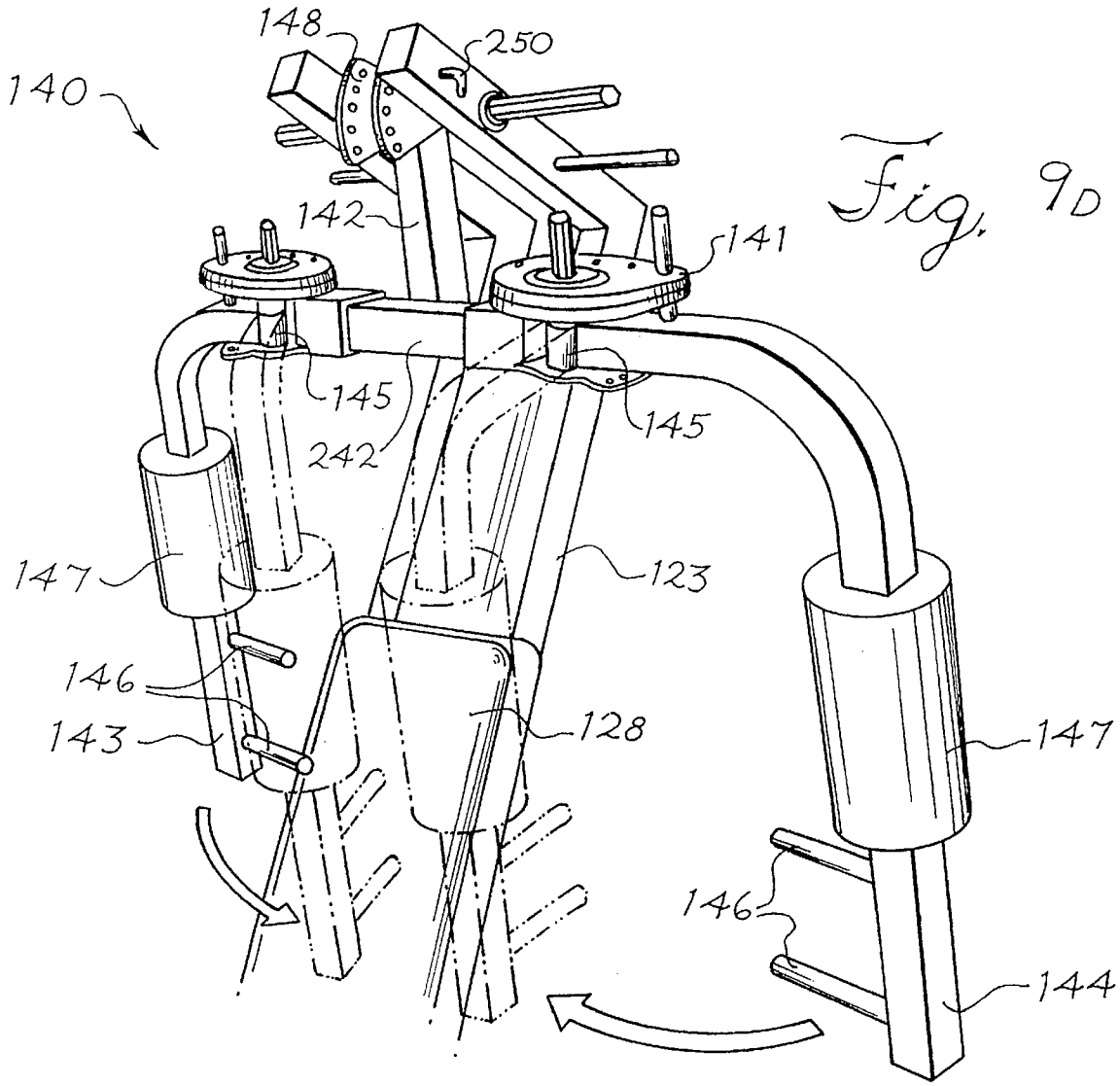

The third exercise, is performed with pivot arm 142 in its uppermost position, as depicted in FIG. 9C. The user still faces the machine. When the user is sitting on seat 122 in the starting position, the user's arms are fully extended over the user's head. The user performs lat pull-downs by reaching up and pulling arm levers 143, 144 downward.

The fourth exercise is performed with the pivot arm 142 in its lowest position, shown in FIG. 9D. The user must make pivot arm 142 stationary by inserting a butterfly lock out pin 250 through aperture 251. Butterfly lock out pin 250 extends through upright bars 124 and 126, positioning plates 148 and pivot arm 142. Pins 249 are removed and resistance mechanisms 141 are moved to their horizontal position on pivot axes 145, which includes a hex-shaped shaft. The user is seated on seat 122 and the user's back rests against back pad 128. The user's elbows are placed against hand grips 146 and the user's forearms rest on the cushioning pads 147. Then, the user pushes the arm levers 143 and 144 toward one another so that user's arms ultimately meet.

The fifth and sixth exercises utilize the second exercise station. The fifth exercise, seated leg extensions, is performed with the user sitting on seat 122 (FIG. 10). The user's knees should be placed over knee supports 151, 152 and the user's ankles should rest behind ankle supports 154 and 155. The user lifts the ankles upward until the legs are virtually horizontal. The sixth exercise, standing reverse leg cuds, is performed by standing and facing the machine so that the back of the user's ankles rests against ankle supports 154 and 155. The user pushes one ankle back and upward until the knee bends at a 900° angle. After returning the ankle to its original position, the exercise may be repeated using the opposite leg.

The seventh and eighth exercises utilize the third exercise station 160 (FIG. 11). To perform the seventh exercise, the user sits on seat 161 so that cushioning pad 163 is positioned across the user's chest near the shoulders. The user pushes cushioning pad 163 forward and down toward his knees.

The eighth exercise is accomplished with the user still seated on seat 161. However, this time the user is repositioned so that the cushioning pad 163 rests against the back of the user's shoulders. The back muscles are exercised when the user leans backward.

One variation of the preferred embodiments of this invention lies in varying the number of shafts 60 and support arms 70. In the preferred embodiment, there are an equal number of shafts 60 and support arms 70. However, exercise machines 10 utilizing a form of resistance other than the torsion elastic spring 32 may not utilize support arms 70.

Another variation lies in modifying the positioning element 50 so that it includes a single plate 52 which receives the pin 56.

There are many advantages to the resistance machine 10 of the present invention. The positioning element 50 disclosed makes the pivot arm 40 extraordinarily easy to use. This allows the exercisers to make more efficient use of their time. It also inevitably increases their enjoyment of the machine 10.

Another advantage of the resistance machine 10 of the present invention is that the resistance mechanism 30 is uncomplicated and durable.

A third advantage lies in the fact that the torsion elastic springs 32 allow for a light weight machine. For example, approximately ten pounds of resistance may be obtained from a two pound spring. Therefore, the machine as a whole is much lighter than weight benches utilizing metal weights. The torsion elastic springs 32 also allow the machine to be packaged in a smaller, lighter box. The torsion elastic springs also make the machine easy to use because they are the same size regardless of the amount of weight they provide.

A further advantage of the resistance machine 10 of the present invention is that the corresponding hex configuration of the inner casing 35 of the central bore 34 of the torsion elastic spring 32 and the shaft 60 produces tight tolerance. Also, the support arm 70 keeps the resistance mechanism 30 from rotating about the axis of shaft 60 which ensures that the maximum amount of energy is stored in the rubber during exercise.

Figure 12:
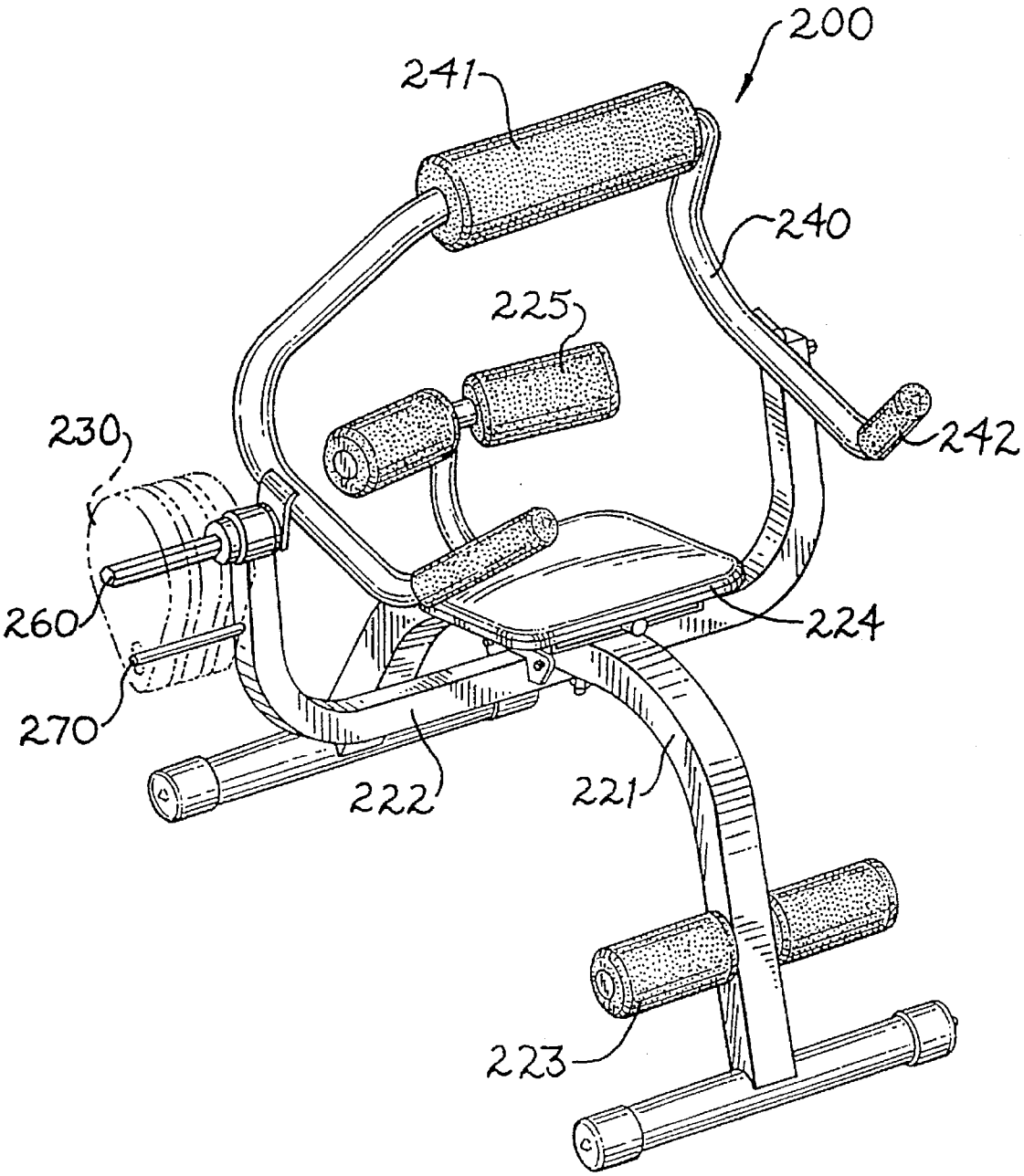
FIG. 12 is a right, front perspective view of an abdominal/back exercising apparatus with the pivot arm in a first position.
Figure 13:
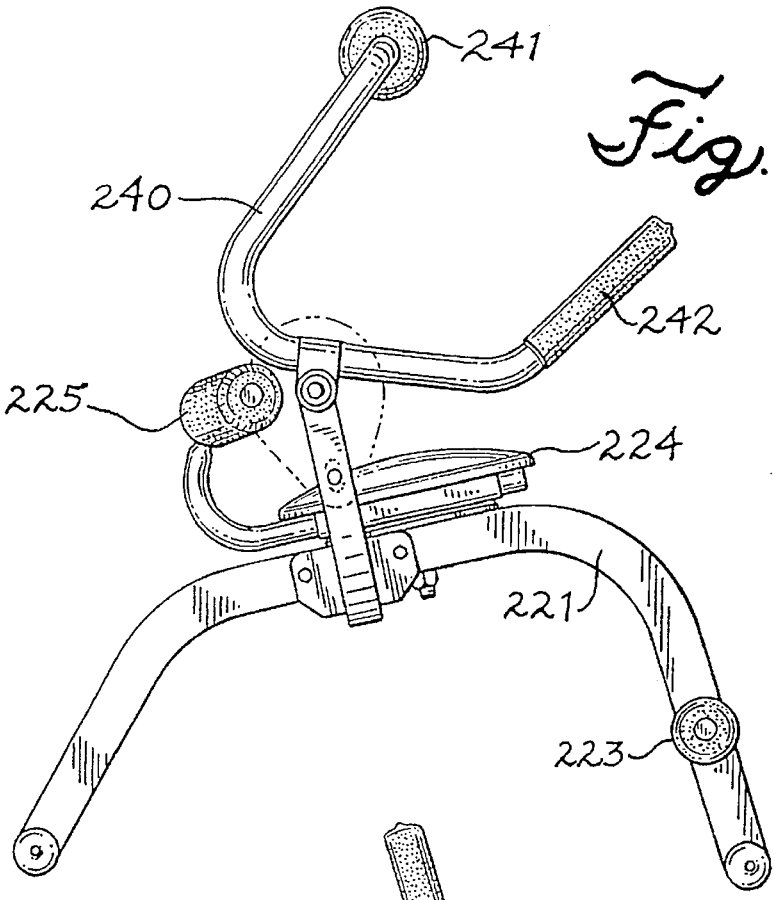
FIG. 13 is a fight side elevational view of the abdominal/back exercising apparatus of FIG. 12.

Referring to FIGS. 12–17, a third embodiment of the exercising apparatus of the present invention is an abdominal/back exercising machine 200. As illustrated in FIG. 12, the machine 200 includes a frame 220. In the preferred embodiment the frame 220 comprises two members: top frame member 222 and bottom frame member 221. Bottom frame member 221 extends longitudinally from the front to the rear of the machine and acts as the main support for the rest of the apparatus. Bottom frame member 221 preferably has a mid section that is angled backward and includes a support member 223 for the users ankles. Top frame member 222 is U-shaped and is connected to the mid portion of bottom frame member 221 as illustrated in FIGS. 12 and 13. It should be understood that the particular shape of the frame 220 is not critical to the present invention. The frame 220 provides a surface for mounting other members and a base which prevents the machine 200 from tipping during use.

Figure 16:
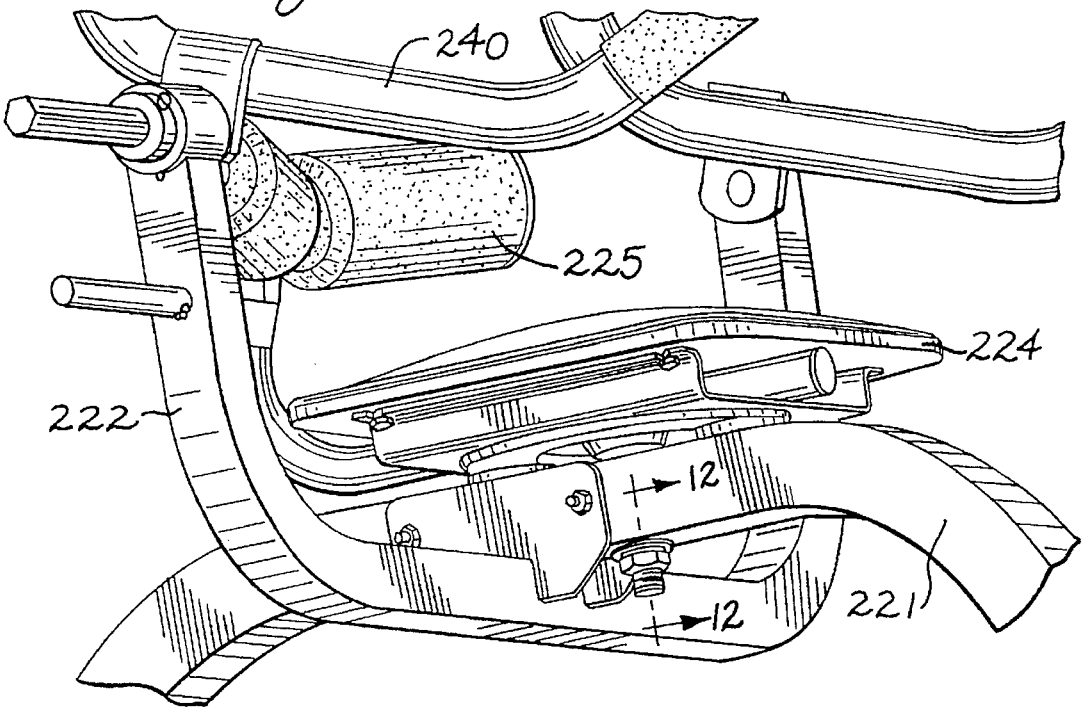
FIG. 16 is a right, from perspective view of the seat of the abdominal/back exercising apparatus of FIG. 12.
Figure 17:
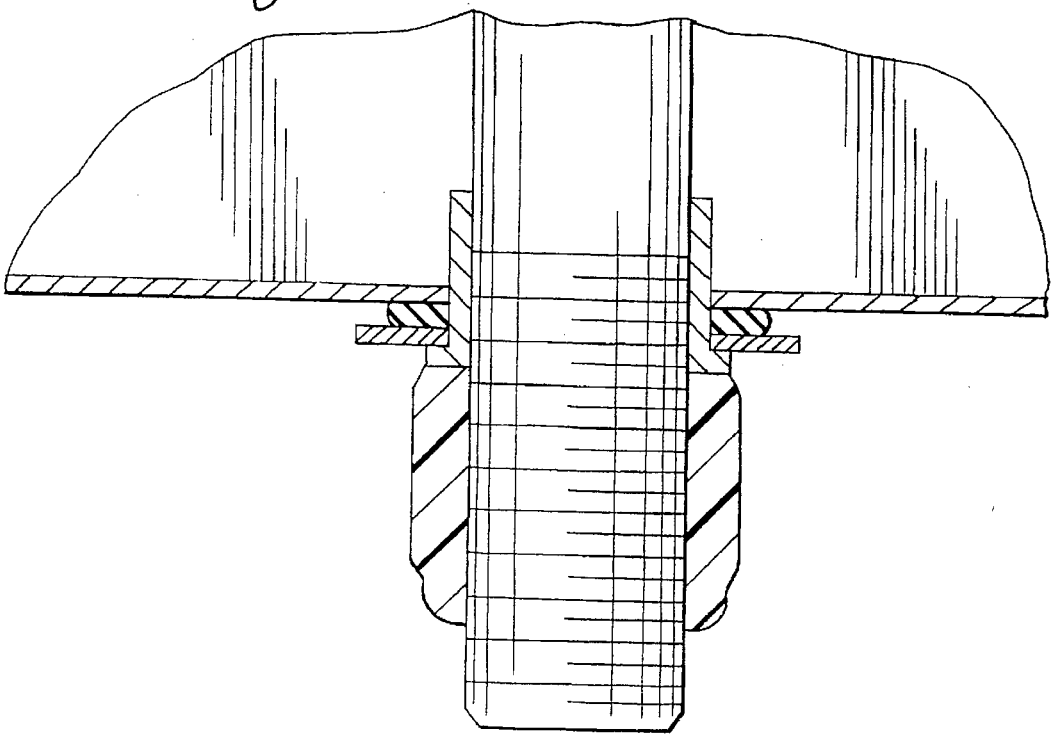
FIG. 17 is a cross-sectional view of the seat of FIG. 16 taken along line 12—12.

The embodiment of FIG. 12 also includes seat 224. As shown in FIGS. 16 and 17, in the preferred embodiment, the seat 224 is rotatably mounted to bottom frame member 221. The seat 224 has the capacity to change angles. A back support 225 is mounted beneath seat 224. Top frame member 222 supports a pivot arm 240. Movement of the pivot arm 240 is opposed by the resistance mechanism 230. The preferred resistance mechanism is the torsion elastic spring used in the embodiments of FIGS. 1–11. Most preferably, the resistance mechanism is a torsion elastic spring capable of bidirectional resistance.

As illustrated in FIG. 12, the pivot arm 240 of this embodiment is configured so as to partially surround a user. The pivot arm possesses more than one body contacting surface 241, 242 and therefore is capable of being moved by the front or back of a user's body. Body contacting surface 241 supports the user's back. Body contacting surfaces 242 function as handles for the user's hands. As shown in all of the figures, the body contacting surfaces may be covered with pads which provide comfort to the user.

The embodiment of FIG. 12 also includes a shaft 260 and support arm 270. The shaft 260 is welded to the pivot arm 240 and then inserted into the proper aperture in top frame member 222. The support arm 270 is inserted into a corresponding aperture in top frame member 222 and thus held securely in place. Preferably, the shaft 260 possesses a noncircular cross-section, most preferably a hexagonal cross-section. A multisided cross-section allows the neutral position of the pivot arm 240 be adjusted with respect to the frame by repositioning the resistance mechanism 230 on the shaft 260.

Figure 14:
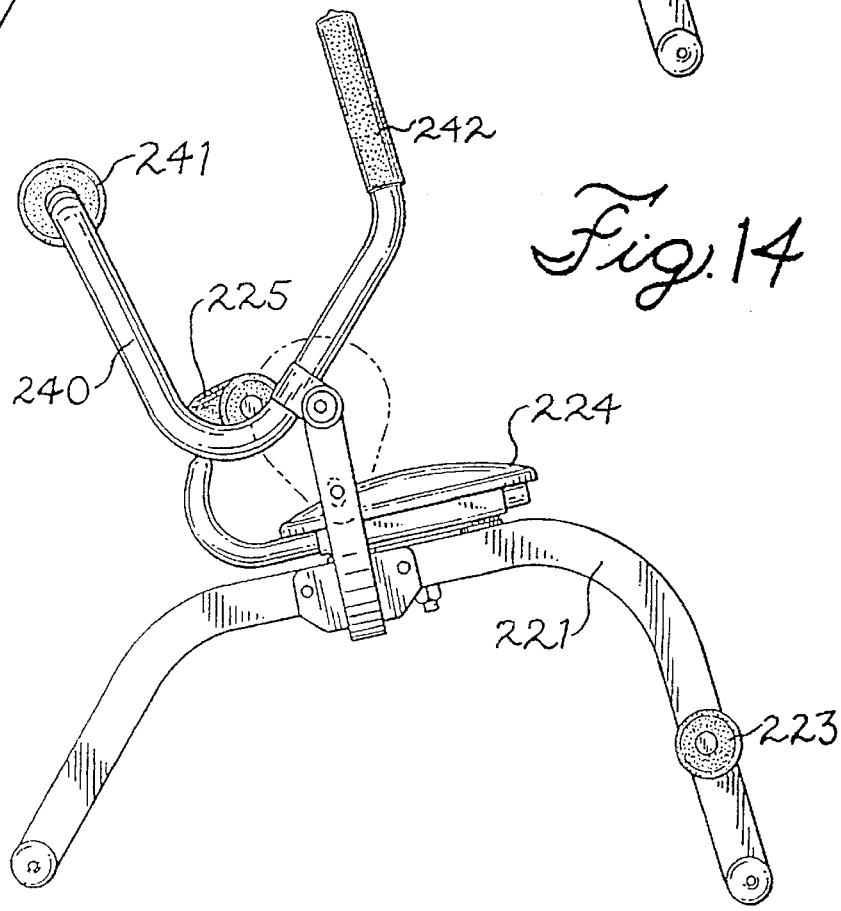
FIG. 14 is a right side view of the abdominal/back exercising apparatus of FIG. 12 showing the pivot arm in an alternate position.
Figure 15:
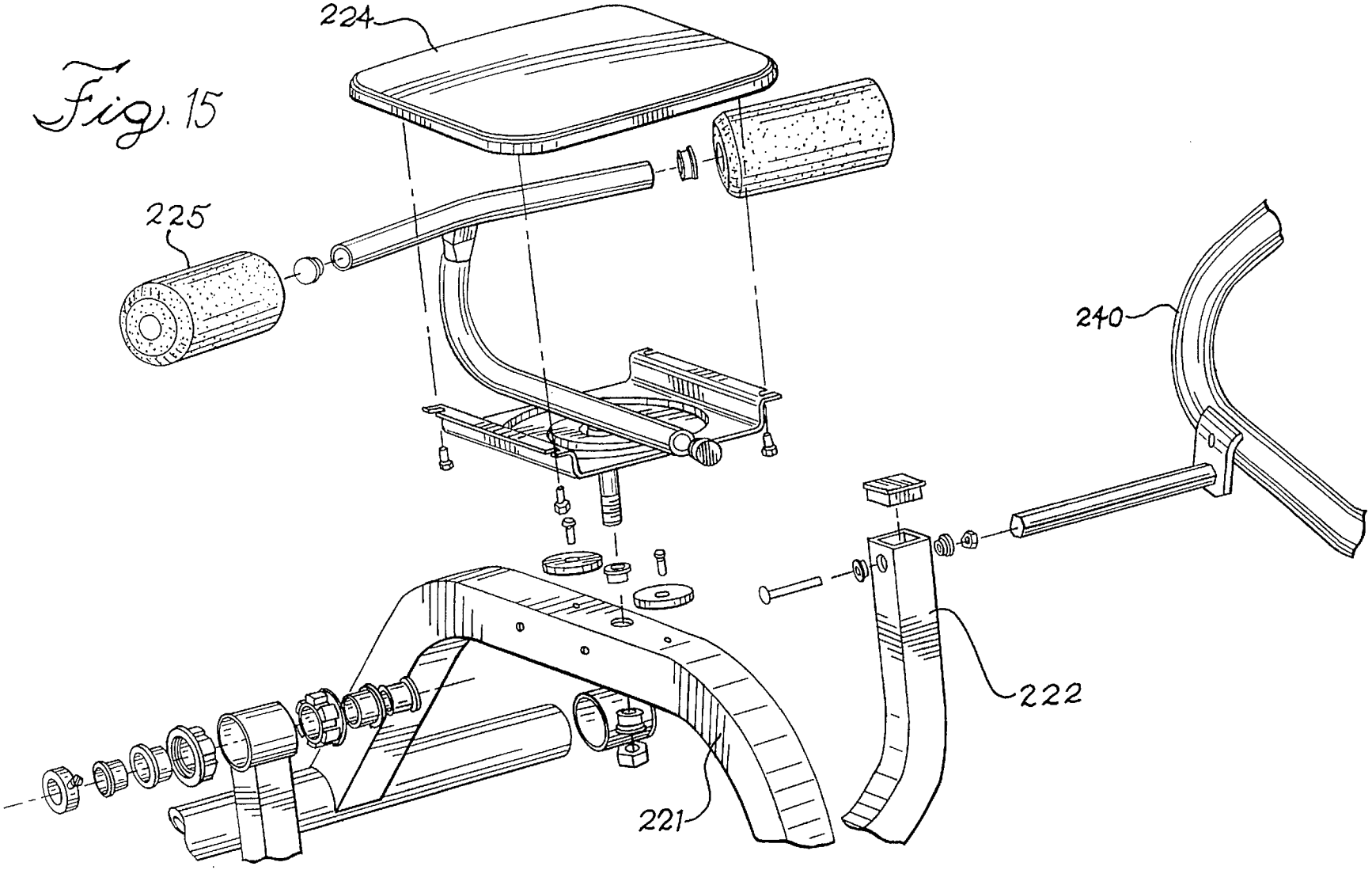
FIG. 15 is an exploded view of the abdominal/back exercising apparatus of FIG. 12.

FIGS. 12 and 13 illustrate the abdominal/back exercising apparatus 200 with the pivot arm 240 in a first neutral position. FIG. 14 depicts the pivot arm 240 in an alternate neutral position. In order to move the pivot arm 240 from one position to another, the resistance mechanism 230 must be removed from the shaft 260 and support arm 270. The user then moves the pivot arm 240 to the next position and replaces the resistance mechanism 230. The shape of the shaft cross-section is particularly significant because it controls the location of neutral pivot arm 240 positions. For instance, if the shaft 260 possesses a hexagonal cross-section, the pivot arm 240 may assume a neutral position every 60°. In order to simplify use of the machine, labels indicating proper pivot arm 240 placement may be painted or placed on the frame.

The abdominal/back exercising machine 200 will be better understood by explaining the different exercises that may be performed by the machine 200. The machine 200 is capable of performing four different exercises. The first exercise, called "the back extension", strengthens the muscles of the lower back. The pivot arm 240 is placed in a first position indicated in FIGS. 12 and 13. The user sits back into the seat 224 with the lower back resting against the back support 225 and the upper back pressed against body contacting surface 241. The user's feet are secured under the ankle supports 223 and the user's hands grip the handles 242. The exercise is performed by extending backwards slowly and then returning the pivot arm to its neutral position.

The other exercises are performed with the pivot arm 240 in the alternate position as indicated in FIG. 14. The second exercise, the "abdominal crunch" strengthens the front abdominal muscles. The user sits on the seat 224 and secures both feet under ankle supports 223. The user keeps the elbows close to the user's side and lightly grips handles 242. The user contracts the abdominal muscles and cuds forward. The pivot arm is subsequently returned to its normal position.

The third exercise, "the side twist" targets the waist and rear oblique muscles. This exercise uses body weight as resistance and therefore does not require a resistance member 230 except to keep the pivot arm 240 in place. The user remains seated and raises the legs so that the knees are slightly bent and the ankles are crossed. The upper body is kept stable by holding hand grips 242. The exercise is performed by swinging the lower body from side to side thus causing seat 224 to pivot about its rotatable connection. See FIG. 15.

The final exercise, "the oblique crunch", tightens and tones the side abdominals and oblique muscles. The user angles the seat 224 slightly to one side and secures both feet under the same side of ankle support 223. The user grips handles 242 and, while keeping the knees together, curls forward targeting the oblique muscles. The pivot arm is then returned to its neutral position. After exercising one side, the exercise may be repeated with the seat 224 and legs positioned on the opposite side.

One variation of this embodiment of the invention involves various methods of changing the neutral position of the pivot arm. For example, the neutral position of the pivot arm could be altered by changing the position of the support arm. More specifically, the support arm could be modified so that it is capable of being attached to the frame in several locations. Thus, the neutral position of the pivot arm would be changed by removing the support arm from its initial position and attaching the support arm to the frame at a second location, thus repositioning the elastomeric torsion member. An exercise machine incorporating this variation might look like the machine depicted in FIG. 12 except that the frame would be configured to accept the support arm in at least two locations located on a circle, the center of which is the axis of shaft 260.

There are many advantages to the abdominal/back exercising apparatus of the present invention. For example, the machine is capable of exercising a variety of muscle groups. In addition, the angled shaft allows for easy repositioning and makes the device extraordinarily easy to use. These advantages allow the exerciser to make more efficient use of their time. Thus, their enjoyment of the machine is inevitably increased.

A further advantage is the compact size and durability of the machine.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. An exercise apparatus comprising:

a) a frame;

b) at least one torsion member for creating resistance mounted to said frame, said torsion member mounted in a casing containing a plurality of bores;

c) a shaft pivotally mounted to said frame for conveying torque to said torsion member, said shaft being received by one of said bores in the casing of said torsion member;

d) a support arm mounted on said frame for opposing rotation of said torsion member about the axis of said shaft, said support arm being received by another of said bores in the casing of said torsion member, and e) a pivot arm mounted on said frame and connected to said shaft such that movement of said pivot arm from a neutral position is resisted by said torsion member.

2. An exercise apparatus according to claim 1 wherein said casing is made of plastic.

3. An exercise apparatus according to claim 1 wherein said casing has ribs to provide structure and support and is designed to transmit force between the shaft receiving bore and the torsion member.

4. The exercise apparatus of claim 1 wherein the plurality of bores comprises two bores.

5. An exercise machine comprising:

(a) a frame;

(b) a pivot arm pivotally mounted to said frame having a neutral position, said pivot arm configured to be movable alternatively by the front and the back of a user's body while the user is in a single position; and (c) at least one resistance member connected to said pivot arm providing bidirectional resistance to movement of said pivot arm.

6. The resistance machine according to claim 5 wherein the resistance member is an elastomeric torsion member.

7. The resistance machine according to claim 6 further comprising:

a) a shaft rotatably mounted to said frame for conveying torque to said elastomeric torsion member; and b) a support arm mounted on said frame for opposing rotation of said elastomeric torsion member about the axis of said shaft.

8. The resistance machine according to claim 7 wherein said shaft possesses a non-circular cross-section such that the neutral position of said pivot arm may be pivotally adjusted with respect to said frame by repositioning said elastomeric torsion member on said shaft.

9. A resistance machine according to claim 7 further comprising a seat rotatably connected to said frame.

10. A resistance machine according to claim 7 wherein said frame comprises a top frame member and a bottom frame member comprising a mid section which is angled.

11. An exercise machine comprising:

(a) a frame;

(b) a seat rotatably connected to said frame;

(c) a pivot arm pivotally mounted to said frame having a neutral position, said pivot arm configured to be moveable alternatively by the front and the back of a user's body while the user is in a single position; and (d) at least one resistance member connected to said pivot arm providing bidirectional resistance to movement of said pivot arm.

12. A resistance machine for exercise comprising:

a) a frame;

b) a pivot arm mounted on said frame;

c) at least one elastomeric torsion member for creating resistance to movement of said pivot arm mounted to said frame;

d) a shaft pivotally mounted to said frame for conveying torque to said elastomeric torsion member, said shaft possessing a noncircular cross-section; and e) a support arm mounted on said frame for opposing rotation of said elastomeric torsion member about the axis of said shaft;

wherein the neutral position of said pivot arm may be pivotally adjusted with respect to said frame by repositioning said elastomeric torsion member.

13. The resistance machine recited in claim 12 wherein said elastomeric torsion member provides bidirectional resistance.

14. The resistance machine recited in claim 12 wherein said shaft possesses a hexagonal cross-section.

15. A resistance machine for exercise comprising:

a) a frame;

b) a seat rotatably connected to said frame;

c) at least two support members mounted to said frame, one for supporting a user's back and the other for supporting the user's feet;

d) at least one pivot arm pivotally mounted to said frame having a neutral position, said pivot arm configured to be moveable alternatively by the front or the back of a user's body;

e) at least one elastomeric torsion member for creating bidirectional resistance to movement of said pivot arm mounted to said frame;

f) at least one shaft pivotally mounted to said frame for conveying torque to said elastomeric torsion member, said shaft possessing a noncircular cross-section; and g) at least one support arm mounted on said frame for opposing rotation of said elastomeric torsion member about the axis of said shaft, wherein the neutral position of said pivot arm may be pivotally adjusted with respect to said frame by repositioning said resistance member.

16. A resistance machine for exercise according to claim 15 wherein said shaft possesses a hexagonal cross-section.

17. A method of changing the neutral position of a pivot arm on a resistance machine for exercise comprising a frame; a pivot arm mounted on said frame; at least one elastomeric torsion member for creating resistance to movement of said pivot arm mounted to said frame; a shaft pivotally mounted to said frame for conveying torque to said elastomeric torsion member, comprising the following steps performed by a user:

a) removing said elastomeric torsion member from said shaft;

b) rotating said pivot arm from a first neutral position to a second neutral position; and c) replacing said elastomeric torsion member on said shaft.

18. A method of using a resistance machine for exercise comprising a frame; a seat connected to said frame; a pivot arm mounted on said frame, said pivot arm configured to be movable alternatively by the front and the back of a user's body; at least one elastomeric torsion member for creating resistance to movement of said pivot arm mounted to said frame; a shaft pivotally mounted to said frame for conveying torque to said elastomeric torsion member, comprising the following steps performed by a user:

a) placing said pivot arm in a first neutral position;

b) sitting on said seat;

c) moving said pivot arm with the front of the body;

d) returning said pivot arm to said first neutral position;

e) removing said elastomeric torsion member from said shaft;

f) rotating said pivot arm to a second neutral position;

g) placing said elastomeric torsion member on said shaft;

h) moving said pivot arm with the back of the body; and i) returning said pivot arm to said second neutral position.

19. A method of using a resistance machine for exercise comprising a frame and a seat rotatably connected to said frame comprising the following steps performed by a user:

a) sitting on said seat;

b) raising and extending the legs so that knees are only slightly bent;

c) crossing the ankles;

d) pivoting said seat about its rotatable connection by swinging the legs from side to side.

20. A method of using a resistance machine for exercise comprising a frame, a pivot arm mounted on the frame and a seat rotatably connected to said frame comprising the following steps performed by a user:

a) sitting on said seat;

b) rotating said seat slightly to one side;

c) positioning feet so that they are both placed to one side of said frame;

d) moving said pivot am with the front of the body; and e) returning said pivot am to its neutral position.

21. An exercise machine comprising:

a) a frame;

b) a pivot arm pivotally mounted to said frame having a neutral position, said pivot arm configured to be movable alternatively by the front and the back of a user's body;

c) at least one elastomeric torsion member connected to said pivot arm for providing bidirectional resistance to movement of said pivot arm;

d) a shaft rotatably mounted to said frame for conveying torque to said elastomeric torsion member; and e) a support arm mounted on said frame for opposing rotation of said elastomeric torsion member about the axis of said shaft.

22. An exercise machine comprising:

a) a frame;

b) a pivot arm pivotally mounted to said frame having a neutral position, said pivot arm configured to be movable alternatively by the front and the back of a user's body;

c) at least one elastomeric torsion member connected to said pivot arm for providing bidirectional resistance to movement of said pivot arm;

d) a shaft rotatably mounted to said frame for conveying torque to said elastomeric torsion member, said shaft possessing a non-circular cross-section such that the neutral position of the pivot arm may be pivotally adjusted with respect to said frame by repositioning said elastomeric torsion member on said shaft; and e) a support arm mounted on said frame for opposing rotation of said elastomeric torsion member about the axis of said shaft.

23. An exercise machine comprising:

a) a frame;

b) a pivot arm pivotally mounted to said frame having a neutral position, said pivot arm configured to be movable alternatively by the front and the back of a user's body;

c) at least one elastomeric torsion member connected to said pivot arm for providing bidirectional resistance to movement of said pivot arm;

d) a shaft rotatably mounted to said frame for conveying torque to said elastomeric torsion member;

e) a support arm mounted on said frame for opposing rotation of said elastomeric torsion member about the axis of said shaft; and f) a seat rotatably connected to said frame.

24. An exercise machine comprising:

a) a frame having a top frame member and a bottom frame member, said bottom frame member comprising a mid-section which is angled;

b) a pivot arm pivotally mounted to said frame having a neutral position, said pivot arm configured to be movable alternatively by the front and the back of a user's body;

c) at least one elastomeric torsion member connected to said pivot arm for providing bidirectional resistance to movement of said pivot arm;

d) a shaft rotatably mounted to said frame for conveying torque to said elastomeric torsion member; and e) a support arm mounted on said frame for opposing rotation of said elastomeric torsion member about the axis of said shaft.

* * * * *